United States Patent [19]

Sornes

[11] Patent Number: 4,519,228

[45] Date of Patent: May 28, 1985

[54] ELECTRONIC RECODEABLE LOCK

[75] Inventor: Tor Sornes, Moss, Norway

[73] Assignee: TrioVing A/S, Moss, Norway

[21] Appl. No.: 361,343

[22] Filed: Mar. 24, 1982

[30] Foreign Application Priority Data

Apr. 1, 1981 [NO] Norway ..... 811112

[51] Int. Cl.[3] ..... E05B 47/00; E05B 49/00

[52] U.S. Cl. ..... 70/276; 70/278; 235/382.5

[58] Field of Search ..... 70/263, 264, 276, 277, 70/278; 361/269; 340/825.31; 235/382.5

[56] References Cited

U.S. PATENT DOCUMENTS

| | | | |
|---|---|---|---|
| 3,622,991 | 11/1971 | Lehrer | 340/147 R |
| 3,763,676 | 10/1973 | Schachter | 70/264 |
| 3,821,704 | 6/1974 | Sabsay | 340/825.31 |
| 3,860,911 | 1/1975 | Hinman | 340/825.31 |
| 3,906,447 | 9/1975 | Crafton | 235/382.5 |
| 3,926,021 | 12/1975 | Genest | 70/278 |
| 4,207,555 | 6/1980 | Trombly | 235/382.5 |

FOREIGN PATENT DOCUMENTS 1167131 5/1984 Canada .

*Primary Examiner*—Robert L. Wolfe
*Attorney, Agent, or Firm*—Lucas & Just

[57] ABSTRACT

The publication relates to a lock system of the type which may be activated and/or recoded by means of a preferably plate formed key and/or recoding unit. The publication relates also to a method for recoding such system and to a key member for recoding the system. The lock system comprises a reading unit reading the code on the key and/or recoding unit, a unit comparing and memorizing the detected code and means for activating the mechanical parts of the lock thereby suspending its locking effect. The purpose of the system is to enable recoding of lock independent of a priority determined sequence of codes on the key and without being dependent of a centrally arranged memorizing unit, memorizing the various codes in sequence. The proposed effects are achieved by including a code section on the key member on to which a recoding command may be recorded. The recoding command is recorded on the key member in a central unit where a correct command for the lock in question is recorded on the recoding section of the key.

3 Claims, 6 Drawing Figures

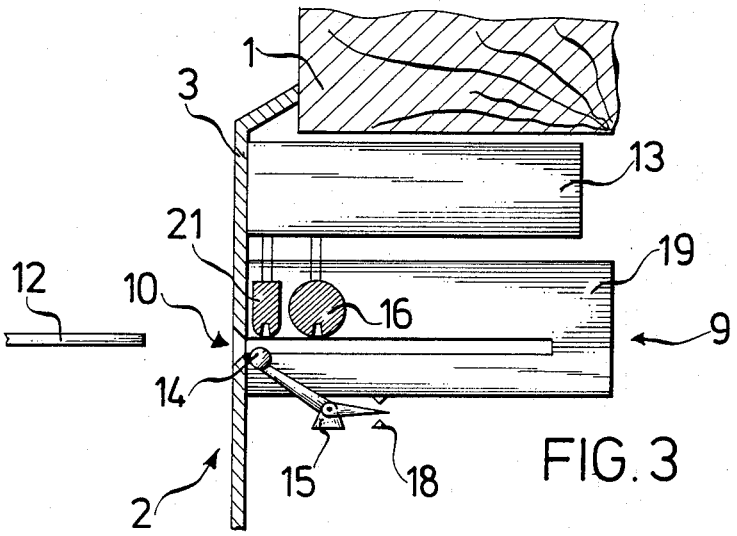
FIG. 3
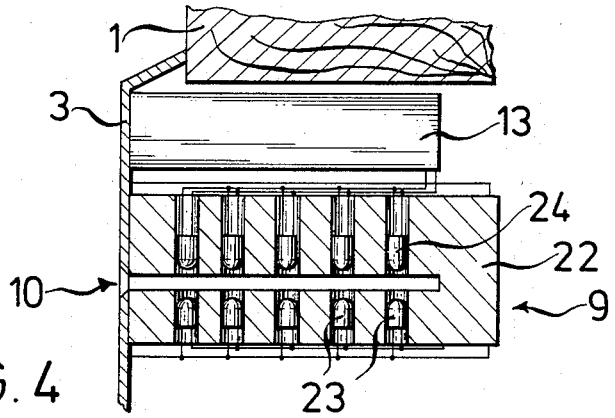
FIG. 4
FIG. 5
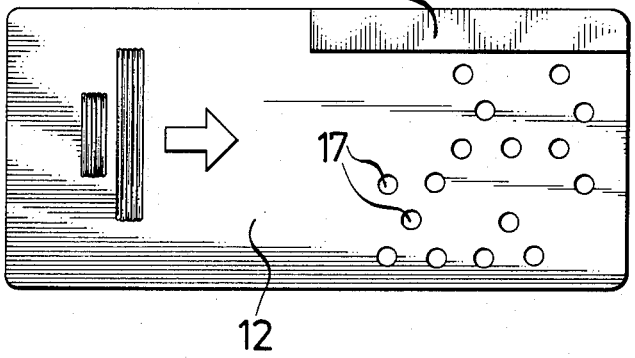

ELECTRONIC RECODEABLE LOCK

The present invention relates to a lock system of a type which may be operated and/or recoded by means of a suitable, preferably plate formed key and/or recoding unit. The invention relates further to a method for recoding such a lock system. Further, the present invention relates to a key member means for recoding locks. The lock system comprises a reading unit reading the code on the key and/or on the recoding section of the key, a unit comparing the read codes with the codes stored in a memory, a memory unit, and means for activating the mechanical part of the lock in order to suspend the locking effect. The present invention is particularly, but not exclusively, suitable for use in hotels, where the code of the keys for the various departments/rooms by simple means frequently have to be changed.

In hotels, it is not unusual that a guest forgets to hand in the key when leaving, or that a key is lost or mislaid. This may of course also happen in other types of institutions. For locks of this type, a system is required where the recoding of the locks to the largest extent may be performed independent of the hotel staff. Further, a solution is required which to the largest possible extent limits the possibility of unauthorized opening of the lock. Consequently, it is desirable to change the combination of the lock relatively frequently in order to reduce the possibility of using previously issued keys which no longer is in authorized possession.

Locks of such type is known. It has previously been proposed a mechanical lock where recoding may be performed manually at the door. However, such solution in timeconsuming and requires frequent attention from the hotel personnel.

It has further been proposed to use electronically based systems, and in particular electronic locks. In particular it has been proposed to use an electronic lock where the code may be automatically changed without being dependent on the hotel staff performing the change manually at the door. This effect is achieved by a lock where the code only may be changed in a certain numerical frequency whereby the key contain one new and one old code. When changing code, the recording key must contain the code of the key which was used last. If this criterion is not satisfied, the electronic memory of the lock will not be activated and consequently the new code will not be recorded. Such way of changing code may best be explain by way of an example: The first key contains for example code 1 and 2, the next key contains code 2 and 3, and the next thereafter contains code 3 and 4 etc. When a key, for example with code 3 and 4, is issued to a newly arrived hotel guest, and the guest insert the key in the lock in his room door, the electronic lock sensor will change the lock code to code 4, if the memory recognize code 3 as the code of the last previously used key. In such a case the lock will automatically be recoded to code 4 and erase code 3 from its memory. If the new key does not contain a code which the lock recognize as the code lastly used, the code of the lock will remain unchanged. This implies in practice that one cannot pass over any one code in the numerical order. Consequently, the hotel must be equipped with a central computer having a memory which stores the used codes so as to issue keys in the right order. If a key is issued and not used, the lock in question has to be manually operated in order to get into the correct sequence again. The central computer and the required means for issuing the keys implies a considerable investment for the hotel. Further, the dependency of a fixed sequence implies large disadvantages for the user/hotel staff.

The object of the present invention is to eliminate said disadvantages whereby the lock in a simple manner may be instructed to be recoded independently of a previously determined order of keys and without having to memorize the various codes centrally. Further, the object is to eliminate the need of a central computer.

According to the present invention this is achieved by inserting the key member which is provided with a code section and a recoding section into a slot in a central recording unit, providing a correct command on the recording section for recoding the lock to the new, issued key member. Consequently the lock is recoded simply by inserting the key member into a slot in the lock, the lock being provided with a reader unit reading the code of the lock and the recoding command, and memorizing the new code, while the old code is deleted from its memory. The command for recoding the lock is preferably erased from the key member when the key member subsequent to the recoding is withdrawn from the slot of the lock. It should be appreciated that the command section/recoding section also may contain a command suspending the erasing command whereby the recoding command remain intact on the key member. The command section may also contain other commands and/or instructions, if required or deemed neccessary.

According to a preferred embodiment, the recoding section may consist of a magnet tape on which the command may be recorded. The tape may preferably be glued to the key member or fixed to the key member in any other conventional way. Alternatively, the recoding command may consist of one or more holes, recesses or ribs on the key member, or a combination of a magnet tape and/or one or more holes, recesses or ribs, said means being arranged in correct position on the key member with respect to the reading unit on the lock. The lock comprises further a unit which erase the commands from the key member subsequent to the recoding. The lock incorporates means which activates for example a magnet if a correctly coded card is inserted into the lock, said magnet activating the mechanical part of the lock to suspend the locking effect whereby the lock may be opened.

The present invention relates further to a key member for opening and recoding such types of locks. The key member is provided with a recoding command section in addition to the code section which activates the lock. The recoding command section may preferably be formed of a magnet tape strip, for example glued or printed on the key member. In general, the code section of the key contains information which cannot be erased or deleted from the key said section may consist at magnet tape or as described above, of a punched key code section.

In order to prevent unauthorized recoding/issuing of an unauthorized code command on the key member, the lock system may be formed in such a way that one or more permanent, fixed position on code section of the key member must be present in addition to the recoding command in order to allow the lock to be recoded. Alternatively, or in addition, the system may be such that the central unit for recording the command on the key member also registers one or more position of the code section of the key member and tranform said registered position to a signal which is recorded on the recoding command unit. According to such a solution, said signal on the recoding command unit must correspond so an existing position on the corresponding code of the key member in order to allow the lock to be recoded.

The central unit may for example record a recoding command comprising a binary signal which correspond to the corresponding room number. By inserting the key member into the central unit and by means of the key board on the central unit, typing in for example the number 304, the central unit will in a conventional manner record a code on the magnet tape on the key member, which the lock on room no. 304 will recognize. The various locks are in advance programmed to be activated only if its own number is present in the recoding signal.

One preferred embodiment of the present invention will now be described in further details in conjunction with the corresponding Figures wherein:

FIG. 3 shows schematically a vertical section through the code reading unit of the reader;

FIG. 4 shows schematically a vertical section through the reading unit according to one preferred embodiment of the present invention;

FIG. 5 shows a side elevation of a key member according to the present invention.

Figure 1:
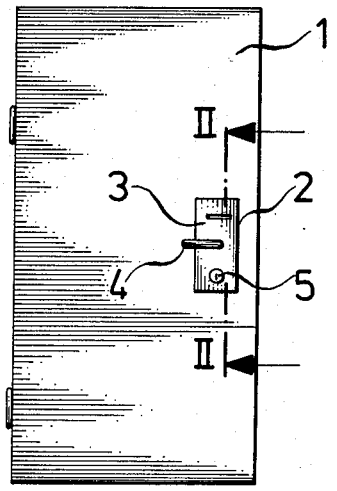
FIG. 1 shows schematically a vertical section of the exterior of a door, the door being providing with a lock according to the present invention.

FIG. 1 shows schematically a vertical elevation of the exterior of a door 1. The door 1 is provided with a lock 2 according to the present invention. The lock 2 comprises a front plate 3, door handles 4 and preferably a lock which for example only is intended to be used when the lock 2 due of damage etc. must be opened with a conventional key member. Further, the lock 2 is equipped with a main lock unit.

Figure 2:
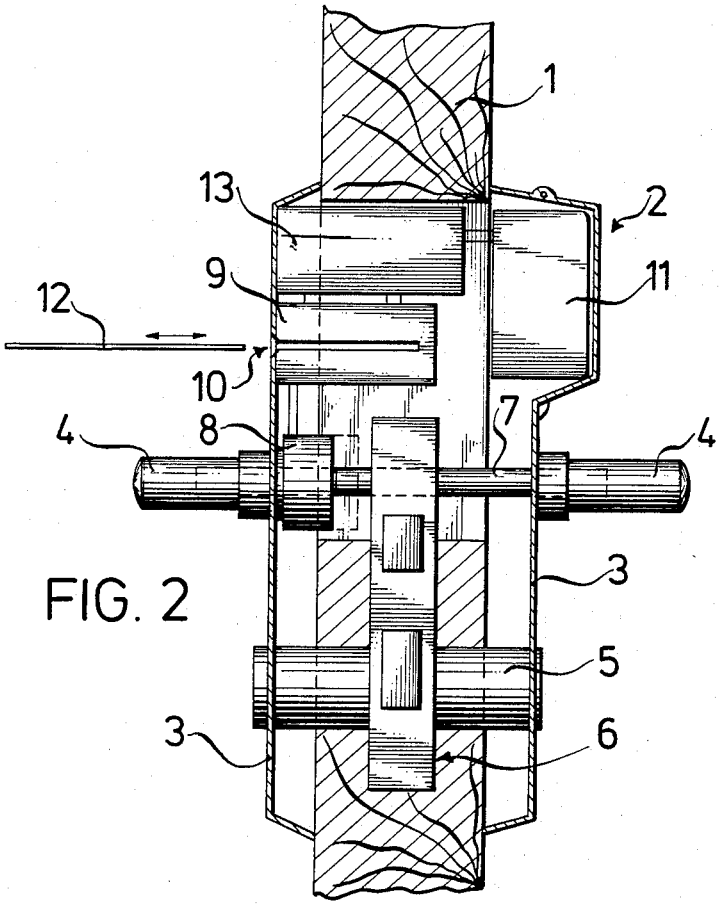
FIG. 2 shows schematically a vertical section through the front edge of a door provided with a lock according to the present invention, seen along line II—II on FIG. 1.

FIG. 2 shows enlarged a vertical section through a part of the door blade 1 with a lock 2, seen along line II—II on FIG. 1. The mechanical part of the lock may be of any conventional known type. According to the embodiment shown on FIG. 2 the mechanical part 6 of the door comprises a door-handle 4 arranged both on the external side and the internal side of the door. The handles 4 are interconnected by means of a pin 7. The pin 7 is equipped with a clutch mean which, when the door is locked, suspend the actuating effect of the handle whereby a rotation of the handle 4 on the outside does not result in opening of the door 1. The clutch means comprises preferably an electric magnetic clutch 8 which is axially displaceable along the pin 7. It should be appreciated, however, that said clutch means may be of any other known conventional type. The lock 2 is intended to be operated by means of a preferably plate formed key member 12, containing a code which is read or sensored by a code reading unit 9 internally arranged in the lock. The reader 9 is for this purpose equipped with a slot 10 having a shape and size which permit the preferably plate formed key member 12 to be inserted.

If a correctly coded key member 12 is inserted the magnet clutch 8 will be actuated, connecting the door handle 4 to the mechanical part 6 of the lock so that the door 1, by turning the door handle 4, may be opened. Current actuating the clutch mean 8 is suppled from a current source 11, such as a battery. The lock 2 is further equipped with a processor 13, powered by said current source 11. The reading unit 13 is provided with a memory and a unit comparing the information which is read and the information contained in the memory. According to the present invention the microprocessor 13 decides whether the coupling 8 should be activated or not. When a key member 12 is inserted into the opening 11, the reader 9 reads the code of the key member 12. Also the reading unit 9 is powered by the battery 11. The battery 11 is preferably arranged on the interior side of the door. The mechanical part 6 of the lock may consist of any known type and do as such not form a part of the present invention. Consequently, the mechanical part 6 will not be described in further detail.

The card reader 9 is equipped with a section which is intended to read the code of the key member 12. The reader 9 is further provided with a section intended to read any commands which the key member may contain and ultimately actuate the microprocessor for recoding etc. Typical commands may be comands for recoding, erasing etc.

FIG. 3 shows schematically a vertical section through the reader or sensor 9, the section being taken along the side of the reader containing the section reading the command section of the key member.

When a key member 12 is inserted into the slot 10, the key member will actuate a switch 18 pressing down an arm 14 arranged on a lever 15. The switch 18 connects the battery 11 to the reading unit 9 and the microprocessor 13. When the key member 12 is introduced further into the slot, the reading unit 9 will read the code and the command for recoding, if any, recorded on the recoding unit 20 on the key member 12. The reading head 16 of the reader is connected to a microprocessor 13, to which the information on the recoding unit 20 on the key member 12 are passed. It should be appreciated, however, that the recoding unit need not neccessarily be provided with a command for reading, but may for example contain a code corresponding to the code designated for the room and/or room number. Such code may be the command, initiating the recoding.

FIG. 5 shows one embodiment of the key member 12. The key member 12 which contains a recoding section 19 is plate formed and is made for example of plastics material. The key member 12 contains a coded section provided with bores 17 forming a code. By using a plate formed card 12 with 32 positions for bores more than 4 billion different codes is possible. The punched or perforated area may contain the individual code of the lock/the key member and/or the code of the master key etc.

FIG. 4 shows schematically a vertical section through the recoding- and reading unit of the reader 22. According to the embodiment shown on FIG. 4, the code of the key members 12 may be read opto-electrical, for example by means of light emitting diodes 23 and photo transistors 24 which are actuated by infrared light. The light emitting diodes 23 and the photo transistors 24 are arranged in a matrix which corresponds to the matrix of the bores 17 on the key member 12. It should be appreciated, however, that conventional locking pins and spring devices may be used instead of light emitting diodes and photo-transistors. In such a case, electrical/mechanical contacts must be arranged between the upper blocking pins and the housing in order to produce an output signal corresponding to the signals produced by the photo-transistors 24.

Along an edge of the key member 12, as shown on FIG. 5, a tape 20 onto which informations may be recorded, is arranged. The tape may be of a type as used in conjunction with tape recorders. The tape may either be printed on the key member or fastened, for example by means of glue. Said tape or tape section 20 is used to give the lock 2, i.e. the microprocessor 13, command to change the recorded code in its memory. If the magnet field or tape 20 contains a command to initiating recoding, the processor 13 will compare its memorized code with the code on the key member 12. If these codes are identical, the magnet coupling will be actuated, by supplying power to the magnet clutch 8, connecting the handle(s) 4 to the pin 7, thereby enabling rotation of the pin 7 and corresponding retraction of the latch bolt or the dead bolt (not shown).

If the magnet tape contains a command to change the code, the reader 9 will record the code on the actual new key member 12 and memorate the new code, erasing the old code. From now on the lock will only be actuated when a key member containing the new code is inserted into the slot. The recoding section of the card reader 9 is further equipped with means 21 for erasing or deleting information on the tape 10 when the key members subsequently is withdrawn from the slot 10. The erasing means 21 is only activated if the tape contains an erase command.

In such a way, recoding of the lock 2 may only be performed once for one and the same key member. This particular coded key member will subsequently only function as a key for suspending the locking effect and may then be used on the lock until a new command is recorded on the key member or a new key 12 with different coding having a change command on command section is used. It should be appreciated that the command for erasing the command on the tape is preferably recorded on the magnet tape.

In reality the hotel receptionist has a large number of cards 12 containing different codes and being equipped with a tape containing no recording. Said tape is of a type which may be magnetized or where codes may be recorded. When a new guest arrives and is given a room, for example room number 504, the receptionist takes any card 12 and inserts the card member 12 into a central unit to produce a command on the tape. Said central unit has a keyboard where the receptionist may key the relevant room number, in this case room number 504. Said central unit will then produce a signal corresponding to the code of the lock for room 504, said signal being recorded on the recoding tape of the key member handed over to the guest. The guest may now go to his room. By inserting the key member into the slot of the lock, the reader will read the command for change of code. It will compare the code for the room number incorporated into the command with its own stored code for room number and if these two codes are identical, the change will occur. When the guest withdraws the key member from the lock, the command and the signal on the tape 20 are erased whereby this key member cannot be used again for recoding unless a new command is recorded on the tape. The key member 12 may now be used only to actuate the opening of the door 504.

The master key(s) codes of the hotel may also be recoded in the same manner. If the master code is to be changed, the change command is recorded on the tape. The change command may not necessarily contain a command for erasing. By using this key member subsequently on all the doors in the hotel, the master code may be changed.

The last information recorded on the key member 12 may for example be a code actuating the erasing unit. When retracting the key member 12, the information on the magnet strip 20 will be erased. When the key member 12 is inserted in the slot, the code is read opto-electrical for example by means of light emitting diodes and photo-transistors. Such solutions is shown on FIG. 4 where the reference number 24 refer to photo-transistors which are activated by infrared light. The punched code is memorized in a microprocessor and is the code for the key.

The central microprocessor 13 consists of a system of a microprocessors, printed circuits and various electronic components (not shown) which a such are well known for a person skilled in this art. The microprocessors are programmed to react upon logic alternatives govern by binary signals. Certain of the components may have storing capacity which may store the reprogrammable informations and other will have stores which are permanent.

Figure 6:
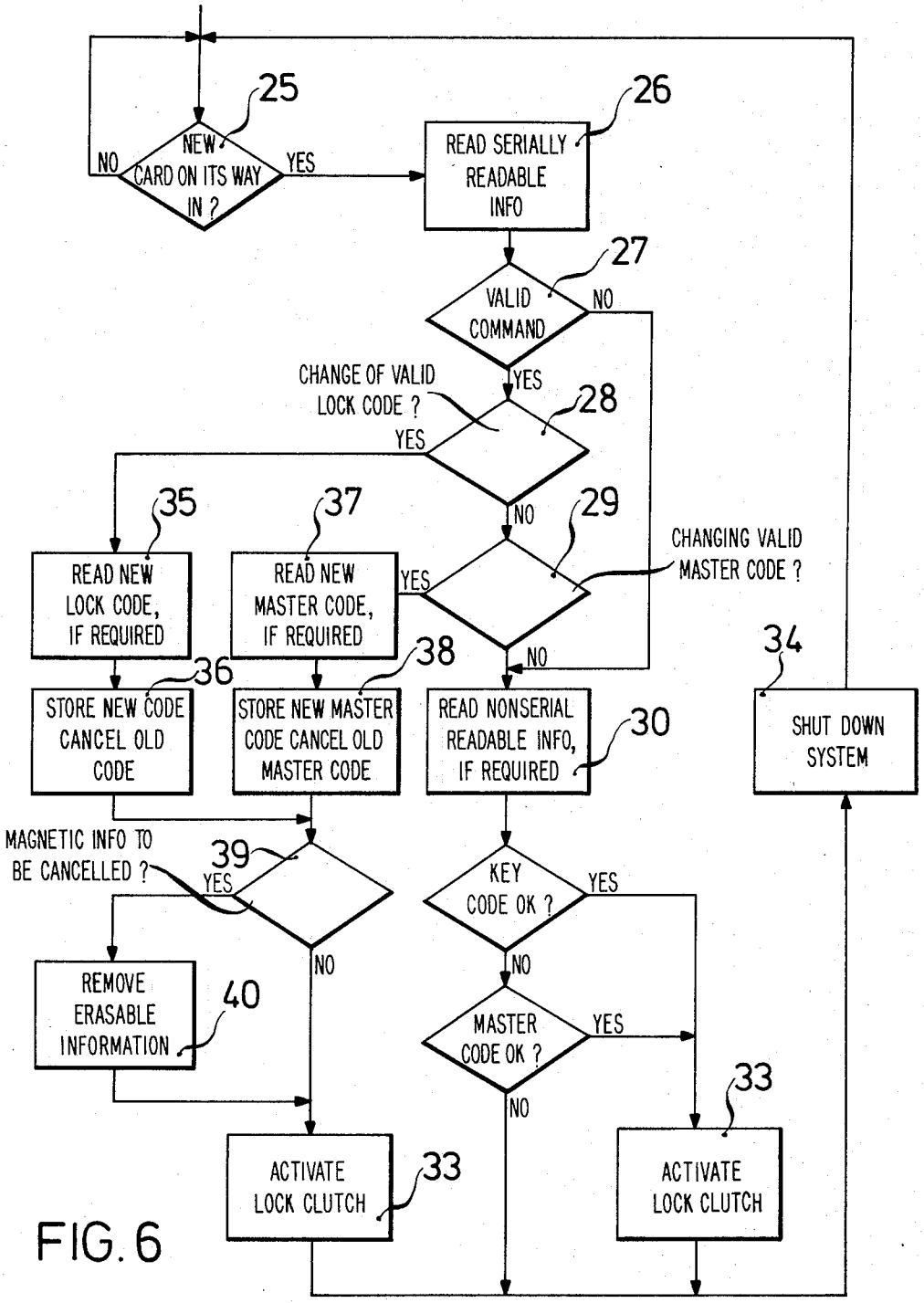
FIG. 6 shows a flow diagram showing the direction of the electrical impulses and informations flowing through the processor incorporated into the lock.

FIG. 6 shows the flow diagram showing the flow of electronic impulses and informations flowing through the central processor. Said flow is initiated when a card/key member is inserted into the slot, and terminated when the proper key member is retracted, causing the locking clutch to be activated. The squares of the diagram mean a process while the rhombus designate a logical function.

As indicated by the top rhombus 25 of the diagram, the card reader will be activated when a key member 12 is inserted into the slot 10 of the card reader 9. The card reader will be actuated by an impulse produced by the switch 18 indicating that a key member 12 is on its way into the slot. Upon a signal from the switch 18, the reading head 16 reads the magnetic information and/or alternatively any serially readable information stored on the recoding section 20 of the key member 12. The reading is terminated when the key member 12 actuates an end switch (not shown) which may be arranged at the far end of the slot, or optionally, if the time taken from the key member 12 was inserted into the slot exceed certain time limit without the end switch been actuated, the power is cut off. This entire process is visualized by the square 26.

The locical function 27 determines whether the command section 20 of the card member 12 contain a valid command information or not. If no valid command information is on the command section 20, the system proceeds to process 30. This process will be described below. If, however, the command section 20 contains a valid command information, the function 28 determines whether the command relates to a change of lock code or not. If yes, the procedure continues to process indicated by 35; if no, the system proceeds to function 29 investigating whether the command relates to change of master code. If yes, it proceedes to the process 37 where a new master code is read and further to process 38 where a new code is stored while the old code is erased. If negative, the system assumes a false alarm in function 27 and it proceeds to process 30. Optionally, other types of tests may be incorporated for testing other commands at a later stage.

If the permanently stored information on the key member consists of a magnet tape or other type of serially readable information, said information is considered as read at the process 26. The flow continues to function 31 where the information which is read, is compared with the code stored in the processor. If, however, the permanently stored information consists of non-serial readable information, the information is read by the process 30 and thereafter compared with the code stored in the processor at function 31. Non-serial readable information may for example consist of recesses, ribs, visual or non-visual optical detectable holes or points on the key member 12.

If the function 31 recognizes the codes, ie. the stored code is identical with the code on the key member, the lock clutch 8 is activated at the process 33. If the detected code is not in agreement with the stored code, the process proceeds to function 32 where the code is comparred with the stored master code. If in agreement, the clutch 8 is activated. If no agreement between the two codes exists the power is cut off at the process 34. The power supply is cut off when the key member 12 is retracted or subsequent to a predeterment time and will only be switched on again when a card is inserted into the slot and activates the switch, cfr. the above described function 25.

If the permanently stored information on the key member 12 is contained on a magnet tape or any type of serially readable information, said information is considered as read at the process 26. The flow continues to process 36 where the new code is stored and the old code is deleted. If said new code, however, consist of non-serially readably information, the new code is read at the process 35 whereafter it is stored at process 36, while the old code is erased.

In both cases the process proceeds to function 39 where signal relating to erasing is produced if the recodeable section contains command for erasing, cfr. process 40, or no erasing will occur if the recoding section does not contain erasing command.

The same procedure as for reading a new code section applies also for reading and recoding a new master code, cfr. process 37 and 38.

The punched code may be divided into several segments whereby different levels of master key codes may exist. For example one master level consist of one hundred locks while another level consists only of ten locks. The magnet strip may also contain commands and informations enabling a key to open for its particular code, but that the lock shall not memorize the code. This may be of use for instance where the key is to be handled to maintenance staff, doing repair etc.

The new and essential feature according to the present invention is to use a magnet tape or similar means containing information which may be erased from the key, the information incorporation commands commanding the lock to react on a permanent code. The code does not neccessarily have to consist of punched openings, but may consist of transparent areas or similar means for optical or magnetical reading. One main feature is that one and same card may contain two different types of codes, one permanently stored and one which may be recorded on the key by the person issuing the key, said recorded information being intended to be erased subsequently to recording of and storing of the code in the memory.

What we claim is:

1. Method for recoding a lock of the type comprising a housing that includes a reading unit and a memory for recording codes for the lock, the lock being actuated by a preferably plate-formed key member containing a key code, the key member having thereon a recoding section on to which informations may be recorded and having a correct command for changing the code of the lock recorded on the recoding section, the method which comprises the steps of recoding said lock by inserting the key member into a slot in the lock, reading the key command for changing the code of the lock in said reading unit and storing the code of the inserted key member in said memory and removing the recording command from the key member upon removing the key member from the lock.

2. A lock assembly positioned in a closure adapted to be recorded and activated by means of a plate-like key and recoding member comprising means for reading a code on the key member, unit means for comparing and memorizing the code read by said reading means and means for actuating the mechanical locking parts of the lock, whereby the lock may be recoded by inserting the key member containing a recoding command into the lock which the unit means recognize and means for removing the recoding command from said key member subsequent to reading the code of the key and subsequent to recoding of the lock.

3. A lock as claimed in claim 2, which includes means responsive to said key member for suspending the removal of the recoding command.

* * * * *